United States Patent [19]

Knudsen

[11] 4,295,567

[45] Oct. 20, 1981

[54] MEDICAMENT CONTAINER

[75] Inventor: Eric T. Knudsen, Cobham, England

[73] Assignee: Beecham Group Limited, England

[21] Appl. No.: 92,922

[22] Filed: Nov. 9, 1979

[30] Foreign Application Priority Data

Nov. 10, 1978 [GB] United Kingdom ..... 44099/78

[51] Int. Cl.[3] ..... B65D 83/02; B65D 85/56; G09F 3/08

[52] U.S. Cl. ..... 206/534; 116/308; 206/459

[58] Field of Search ..... 206/534, 533, 459; 116/308

[56] References Cited

U.S. PATENT DOCUMENTS

| | | | |
|---|---|---|---|
| 3,305,077 | 2/1967 | Greif et al. | 116/308 |
| 3,324,995 | 6/1967 | Sharp Jr. | 206/42 |
| 3,397,671 | 8/1968 | Hartman Jr. et al. | 116/121 |
| 3,515,265 | 6/1970 | Bartnik | 206/534 |
| 3,537,422 | 11/1970 | Moe | 206/533 |
| 3,757,441 | 9/1973 | Bawstin | 116/308 |
| 3,780,856 | 12/1973 | Braverman | 206/534 |
| 4,038,937 | 8/1977 | Moe | 116/308 |
| 4,039,080 | 8/1977 | Cappuccilli | 116/308 |

*Primary Examiner*—William T. Dixson, Jr.
*Attorney, Agent, or Firm*—Jacobs & Jacobs

[57] ABSTRACT

A pharmaceutical dispensing container which holds two dosage units which are symptomatic treatment for respiratory tract disorders, the first of these dosage units being indicated for day-time administration and being non-sedative and the second of these dosage units being indicated for night-time administration and being sedative. Indication means include the dosage units being in register with a time chart and a distinguishing visible feature of the dosage units.

9 Claims, 3 Drawing Figures

MEDICAMENT CONTAINER

This invention relates to a container holding dosage units for the relief of symptoms common to respiratory tract disorders. Such disorders include coughs, colds allergic reactions and the like, for example irritation of the mucous membranes, excessive secretion therefrom and congestion and constriction.

Existing methods of treatment of these symptoms generally use a single type of pharmaceutical formulation which provides 24-hour relief. When, as is often the case, a sedative action is desired at night, such a single formulation regime containing a sedative entails obvious disadvantages during the day.

It is an object of this invention to overcome these disadvantages in a simple and cheap manner.

Accordingly the present invention provides a pharmaceutical dispensing container, which container holds two dosage units which are symptomatic treatments for respiratory tract disorders, the first of these dosage units being indicated for day-time administration and being non-sedative, the second of these dosage units being indicated for night-time administration and being sedative.

It is to be understood that a sedative action according to this invention may be the desired sedative action of a sedative drug contained in the night-time dosage unit, or may be the sedative side-effect of a drug.

Normally the container will hold a plurality of each of the two types of drug dosage units.

One embodiment of the invention will now be described with reference to the accompanying drawings, in which.

Figure 1:
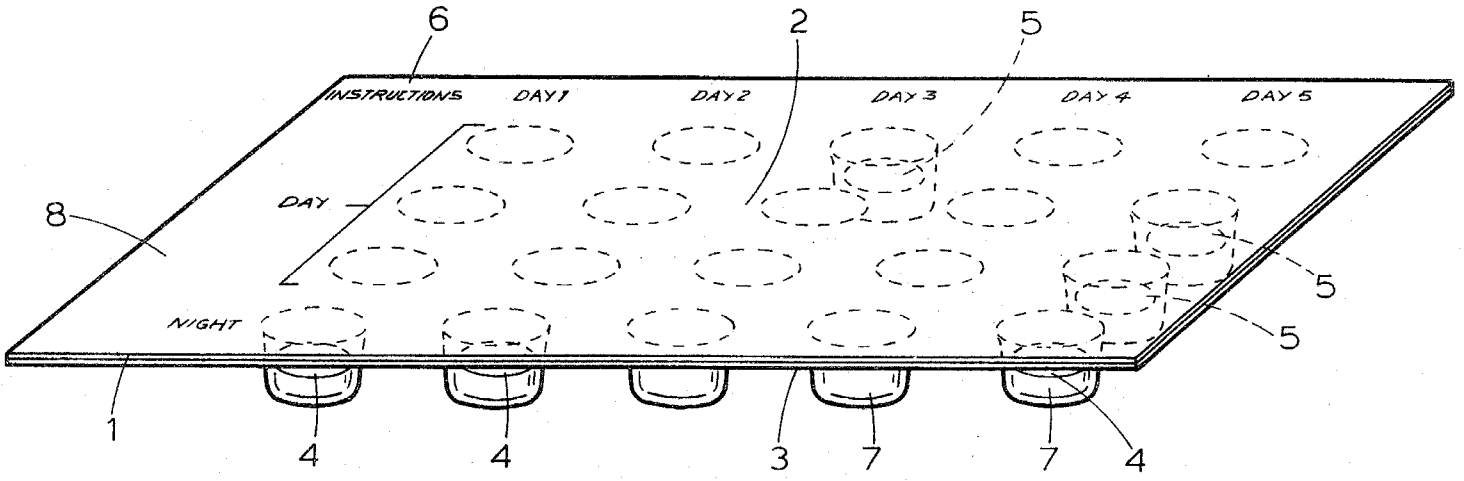
FIG. 1 is a perspective view of the front of a container in accordance with the present invention.
Figure 2:
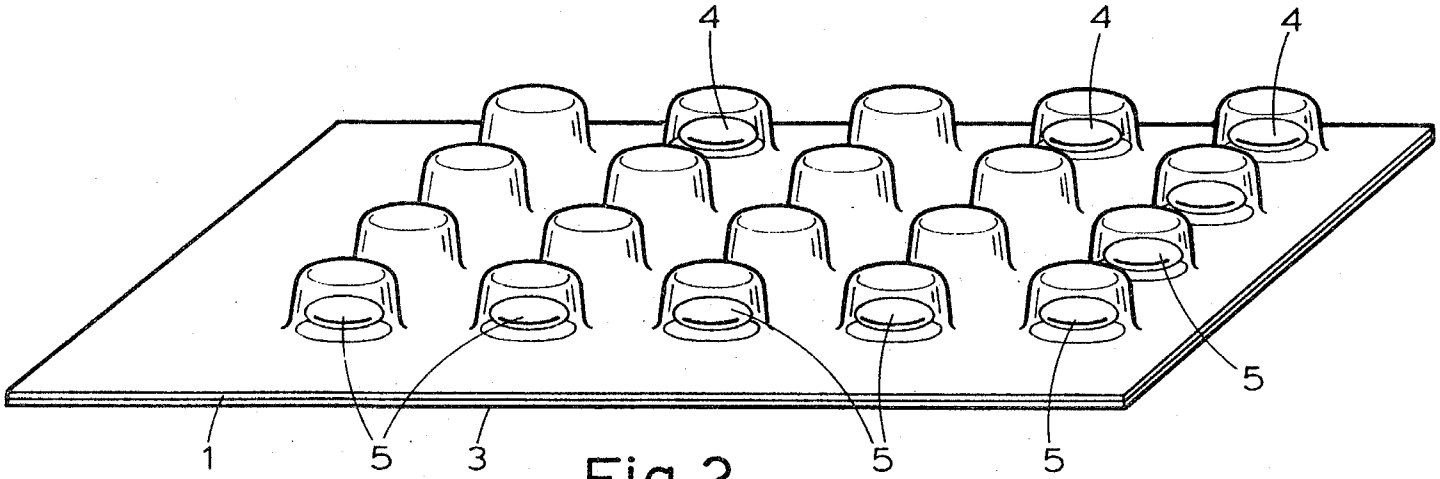
FIG. 2 is a perspective view of the back of the container of FIG. 1.
Figure 3:
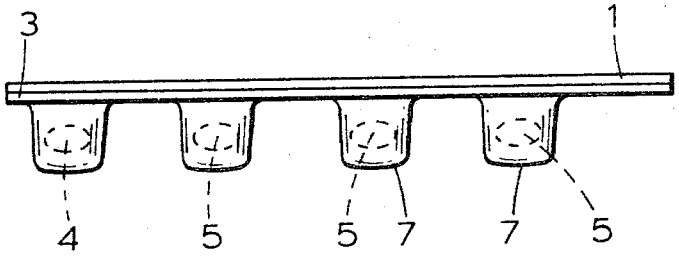
FIG. 3 is a side elevation of the container of FIG. 1.

Referring to FIG. 1 of the drawings, the container is in the form of a blister pack comprising a base 1 with time chart 2 defined thereon; a facing strip 3 affixed to the base 1 having held therein two types of discrete solid dosage units 4 and 5; together with printed instructions 6.

The blister pack shown in FIG. 1 is an elongate rectangle. The time chart 2 is defined on the base 1 by the arrangement of printed words along two axes, one axis being alongside a longer edge of the base 1, the other axis being at right angles to the first. The first axis is defined by the words "Day 1", "Day 2", etc., regularly spaced, these words representing consecutive days of the therapy. The other axis is defined by the words "Day" and "Night", these words representing daytime and night-time within each day of the therapy.

The base 1 has a section 8, outside the time chart 2, on which are printed administration instructions.

The facing strip generally indicated at 3 is of a conventional blister pack type, in which blisters 7 have been formed in a regular grid of four ranks and five files.

The grid of blisters 7 is so arranged in the facing strip 3 that a file of blisters 7 is in register with each of "Day 1", "Day 2", etc. on the base 1 and three ranks of blisters are in register with "Day" and one with "Night" on the base 1.

The two types of discrete solid dosage units generally indicated at 4 and 5 are in the form of soft gelatin capsules located in the closed blisters 7 of the facing strips 3. Dosage units of the type 4 contain a sedative composition and are packed in the rank of blisters 7 in register with the word "Night" in the time chart 2. Dosage units of the type 5 contain a non-sedative composition and are packed in the three ranks of blisters 7 in register with the word "Day" in the time chart 2. The dosage units of the type 4 are of a different colour to those of type 5.

The order of packing of the dosage units of types 4 and 5 located by the blisters 7 of the facing strips 3 in register with the time chart 2, the different colours of the two dosage types and the instructions 6 indicate and facilitate the taking of dosage units of type 4 at night and of dosage units of type 5 by day.

In addition to indicating and facilitating the taking of the various dosage units in accordance with a desired treatment regime, the pack illustrated also conveniently shows when the necessary dosage units have been taken.

To remove any capsule of type 4 and 5 at a time indicated as appropriate as above the corresponding blister 7 containing it is pressed with the finger to push the capsule through the base 1.

The base and facing strip of the blister pack may be of any materials suitable for the construction of blister packs, for example an aluminium foil base and a thermoplastics facing strip.

Although the administration instructions are described as being printed on the base, they may of course be written or printed on a separate surface such as a sheet of paper, or on a label attached to the pack.

Although the pack specifically described is for a five-day dosage regime, it is envisaged that the pack may be adapted for longer or shorter periods of time, as desired, merely by shortening or lengthening the pack and correspondingly decreasing or increasing the number of files of blisters as appropriate.

Further, although the pack specifically described is for a regime of three non-sedative dosage units for daytime use and one for night-time use, it is envisaged that the desired regime may specify any number of dosage units for each aspect of the therapy. Consequently the pack may be adapted in accordance with the requirements of the regime by narrowing or widening the pack and correspondingly decreasing or increasing the number of ranks of blisters and the number of ranks in register with "Day" and "Night" as appropriate.

The blister pack described has a time chart defined on it in the form of ranks and files with corresponding positioning of the dosage unit containing blisters. Of course the time chart, and corresponding blisters, may be in any geometric configuration (such as for example the 'contraceptive pack' arrangement) provided that the time chart clearly indicates which dosage units are to be taken during the day and which dosage units are to be taken at night. Also, the time chart may be omitted, but in this case dosage units of the different types must have a visible distinguishing feature, such as a difference in colour, to indicate that they relate to different aspects of the dosage regime. Of course the time chart and such a distinguishing feature may both be present.

One or more blister packs within the scope of the present invention may be housed in wallets suitable for dispensing.

Containers within the present invention are of course not limted to blister packs. Thus, any conventional pharmaceutical containers are suitable. Examples thereof include bottles, tubes, canisters and packets.

It will be realised that, where such containers do not readily permit the housing of the dosage units in register with a time chart, for example bottles, the dosage units must be mutually distinguished by some visible feature, such as a difference in colour, form, shape or size, or by marks or printing therein, to indicate which dosage units are for day-time and which dosage units are for night-time.

In the embodiment the solid dosage units are soft gelatin capsules. However any discrete solid dosage units are suitably and include tablets, pills, dragees, lozenges and capsules. When the units are capsules, such capsules are conveniently of soft gelatin so that they may be sucked or chewed.

When the dosage units are soft gelatin capsules, the compositions contained in such capsules may be in liquid, gel or solid form. In the case of such suckable or chewable capsules the composition is conveniently in liquid form.

A suitable non-sedative composition for use in the dosage units comprises an antitussive and a decongestant.

A suitable sedative composition for use in the dosage units comprises an antitussive, a decongestant and an antihistamine. Preferably the antitussive and decongestant are the same as those in the non-sedative dosage unit.

Suitably antitussives include codeine, pholcodine and their pharmaceutically acceptable salts, and the like.

Suitable decongestants include phenylpropanolamine and its pharmaceutically acceptable salts such as the hydrochloride.

Suitable antihistamines include promethazine and its pharmaceutically acceptable salts such as the hydrochloride.

In addition to the above active agents it is often advantageous to include other materials which act to relieve other symptoms of respiratory tract disorders, such as analgesics, for example paracetamol, aspirin, caffeine and the like, antipyretics such as aspirin and the like, and expectorants such as guaiphenesin, bromhexene and the like. These materials may be incorporated in either or both types of dosage units, perferably in both for 24-hour relief.

Capsules and tablets may also contain conventional excipients well known in pharmaceutical formulation practice such as, as appropriate, binding agents, gellants, fillers, tabletting lubricants, disintegrants, surfactants, flavourings and colourants.

Often when the dosage units are soft capsules the capsule shell will contain a local anaesthetic such as benzocaine and the like, such as is conventional in cough therapy formulations.

Typical soft capsule formulations for use in the present invention contain the following active ingredients:

| | | |
|---|---|---|
| | Day-time capsule | |
| (1) | phenylpropanolamine hydrochloride | 25 mg. |
| (2) | pholcodine | 10 mg. |
| | or | |
| | codeine phosphate | 20 mg. |
| | Night-time capsule | |
| (1) | phenylpropanolamine hydrochloride | 25 mg. |
| (2) | pholcodine | 10 mg. |
| | or | |
| | codeine phosphate | 20 mg. |
| (3) | promethazine hydrochloride | 20 mg. |

Both formulations suitably contain other conventional ingredients which give the formulation a liquid consistency within the capsule shell.

Preferred night-time capsules contain promethazine theoclate (30 mg) in place of promethazine hydrochloride (20 mg)

What we claim is:

1. A pharmaceutical dispensing container, which contains two dosage units which are symptomatic treatments for respiratory tract disorders, the first of these dosage units being non-sedative, and the second of these dosage units being sedative, and an indicia for distinguishing between said first and second dosage units is provided on at least one of the container and said dosage units.

2. A container according to claim 1, wherein the first of the dosage units is indicated for daytime administration and the second is indicated for night-time administration by means of the dosage units being housed in the container in register with a time chart.

3. A container according to claim 1, wherein the first and second dosage units are mutually distinguished by a visible feature.

4. A container according to claim 1, which container is in the form of a blister pack.

5. A container according to, claim 1 wherein the dosage units are soft gelatin capsules.

6. A container according to claim 5, wherein the capsules are visually distingishable.

7. A method of treating respiratory tract infections, which comprises administering during the daytime at least one dosage unit of a non-sedative composition for symptomatic treatment of respiratory tract disorders in combination with administering during the nighttime at least one dosage unit of a sedative composition for symptomatic treatment of respiratory tract disorders, said non-sedative composition being administered only during the daytime and said sedative composition being administered only during the nighttime.

8. The method according to claim 7 wherein said non-sedative composition comprises an antitussive and a decongestant.

9. The method according to claim 7 wherein said sedative composition comprises an antitussive, a decongestant and an antihistamine.

* * * * *

US004295567B1

REEXAMINATION CERTIFICATE (3315th)

United States Patent [19] [11] B1 4,295,567

Knudsen [45] Certificate Issued Sep. 9, 1997

[54] MEDICAMENT CONTAINER

[75] Inventor: Eric T. Knudsen, Cobham, England

[73] Assignee: Beecham Grp. Ltd., Brentford, England

Reexamination Request:
No. 90/003,514, Aug. 2, 1994

Reexamination Certificate for:

| | |
|---|---|
| Patent No.: | **4,295,567** |
| Issued: | **Oct. 20, 1981** |
| Appl. No.: | **92,922** |
| Filed: | **Nov. 9, 1979** |

[30] Foreign Application Priority Data

Nov. 10, 1978 [GB] United Kingdom ..... 44099/78

[51] Int. Cl.[6] ..... B65D 83/04; B65D 85/58; G09F 3/08

[52] U.S. Cl. ..... 206/534; 116/308; 206/459.5

[58] Field of Search ..... 116/308; 206/459.5, 206/528–540, 570, 803; 312/242

[56] References Cited

U.S. PATENT DOCUMENTS

| | | | |
|---|---|---|---|
| 2,758,710 | 8/1956 | Arens | 206/532 |
| 3,305,077 | 2/1967 | Greif et al. | 206/232 |
| 3,324,995 | 6/1967 | Sharp, Jr. | 206/534 |
| 3,397,671 | 8/1968 | Hartman, Jr. et al. | 206/534 |
| 3,515,265 | 6/1970 | Bartnik | 206/534 |
| 3,537,422 | 11/1970 | Moe | 206/533 |
| 3,675,620 | 7/1972 | Baustin | 206/538 |
| 3,757,441 | 9/1973 | Bawstin | 116/308 |
| 3,780,856 | 12/1973 | Braverman | 206/534 |
| 3,826,222 | 7/1974 | Romick | 206/534 |
| 3,989,823 | 11/1976 | Di Costanzo | 424/195.1 |
| 4,038,937 | 8/1977 | Moe | 116/308 |
| 4,039,080 | 8/1977 | Cappuccilli | 206/534 |

OTHER PUBLICATIONS

Physician's Desk Reference, 29th Edition, 656–657; 659–660; 749–751; 760; 1013; 1228–1229; 1289; 1311–1312.

The Merck Index, 9th Edition, 1976, pp. 777; 939; 1036.

*Primary Examiner*—Jimmy G. Foster

[57] ABSTRACT

A pharmaceutical dispensing container which holds two dosage units which are symptomatic treatment for respiratory tract disorders, the first of these dosage units being indicated for day-time administration and being non-sedative and the second of these dosage units being indicated for night-time administration and being sedative. Indication means include the dosage units being in register with a time chart and a distinguishing visible feature of the dosage units.

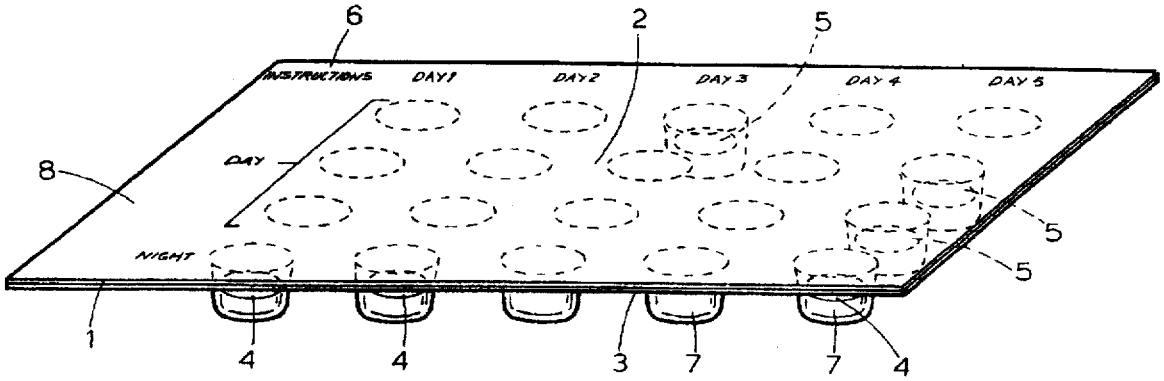

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 7–9 are cancelled.

Claim 1 is determined to be patentable as amended.

Claims 2–6, dependent on an amended claim, are determined to be patentable.

New claim 10 is added and determined to be patentable.

1. A *unitary* pharmaceutical dispensing container *pre-packaged for a user*, which [contains] *is pre-filled and pre-sealed during manufacture of the container with* two *preselected* dosage units which are symptomatic treatments for respiratory tract disorders, the first of these dosage units being non-sedative, and the second of these dosage units being sedative, *said two dosage units being pharmaceutically formulated for use with each other so that coordinated they comprise a single treatment regime for said respiratory tract disorders,* and an indicia for distinguishing between said first and second dosage units is provided on at least one of the container and said dosage units *and said container having administration instructions for the coordinated use of the dosage units according to the single treatment regime such that the non-sedative dosage units are for administration when sedation is not desired and the sedative dosage units are for administration when sedation is desired.*

*10. A pharmaceutical dispensing container, which contains two dosage units which are symptomatic treatments for respiratory tract disorders, the first of these dosage units being non-sedative, and the second of these dosage units being sedative, and an indicia for distinguishing between said first and second dosage units is provided on at least one of the container and said dosage units, which container is in the form of a blister pack.*

* * * * *